US007788775B2

(12) United States Patent
Kutzleb et al.

(10) Patent No.: US 7,788,775 B2
(45) Date of Patent: Sep. 7, 2010

(54) METHOD AND APPARATUS FOR REMOVING WEFT THREADS FROM THE EDGE OF A FABRIC

(75) Inventors: Chester F. Kutzleb, Sagle, ID (US); Roy W. Thompson, Ponderay, ID (US); Gary P. Wells, Sandpoint, ID (US)

(73) Assignee: WIS Seaming Equipment, Inc., Ponderay, ID (US)

( * ) Notice: Subject to any disclaimer, the term of this patent is extended or adjusted under 35 U.S.C. 154(b) by 869 days.

(21) Appl. No.: 11/703,318

(22) Filed: Feb. 6, 2007

(65) Prior Publication Data

US 2008/0000541 A1 Jan. 3, 2008

(51) Int. Cl.
*D06H 5/00* (2006.01)
*D03D 3/04* (2006.01)

(52) U.S. Cl. ..... 28/146; 28/141; 28/142

(58) Field of Classification Search ..... 28/141, 28/142, 146, 145, 170, 171, 151, 152; 139/116.2, 139/116.1, 170.3, 170.4, 383 AA, 302; 26/10.4
See application file for complete search history.

(56) References Cited

U.S. PATENT DOCUMENTS 4,581,794 A * 4/1986 Oldroyd et al. ..... 28/141
4,761,864 A * 8/1988 Berger et al. ..... 28/218
5,060,699 A * 10/1991 Velechovsky ..... 139/116.2
5,117,542 A * 6/1992 Krenkel et al. ..... 28/141
5,209,271 A * 5/1993 Takegawa ..... 139/116.2
5,390,708 A * 2/1995 Kuster et al. ..... 139/383 AA
5,411,063 A * 5/1995 Hacker et al. ..... 139/383 AA
5,720,323 A * 2/1998 Tremer ..... 139/446
5,992,471 A * 11/1999 Chung ..... 139/116.2
6,014,797 A 1/2000 Kuster et al.
6,634,068 B1 10/2003 Kuster et al.
7,168,456 B1 * 1/2007 Kuster et al. ..... 139/170.4

FOREIGN PATENT DOCUMENTS

DE 29506377 10/2005
WO WO 2005/005718 1/2005

* cited by examiner

*Primary Examiner*—Amy B Vanatta
(74) *Attorney, Agent, or Firm*—Wells St. John P.S.

(57) ABSTRACT

A method and apparatus for removing weft threads from an edge of a fabric is described and which includes a bed for supporting a fabric which is manufactured from both warp and weft threads, and which has a forward edge, and an opposite lateral edge; a selectively rotatable draw-off device mounted adjacent to one of the lateral edges and which forcibly engages a first end of a weft thread which is to be removed; and a plurality of wedge assemblies are mounted on the bed, and which are selectively moveable to the forward edge of the fabric, and which facilitate the separation of the weft thread which has been engaged from the forward edge of the fabric.

21 Claims, 10 Drawing Sheets

METHOD AND APPARATUS FOR REMOVING WEFT THREADS FROM THE EDGE OF A FABRIC

RELATED PATENT DATA

The present application claims priority to Austrian Patent Application Serial No. 1092/2006, and which was filed on 28 Jun. 2006.

TECHNICAL FIELD

The present invention relates to an apparatus for removing weft threads from the edge of a fabric, and more specifically to a method and apparatus which facilitates the formation of continuous fabric webs which when incorporated within paper machines are useful in fabricating various paper products.

BACKGROUND OF THE INVENTION

The beneficial effects of employing various continuous fabric belts in the formation of various paper products are well known. Typically, paper machines use three different and very distinct types of woven fabric belts to make paper. These fabric belts are placed in three different locations on a paper machine and are typically referred to as forming, press and dryer belts. As a general matter, these continuous fabric belts are usually 30 to 40 feet in width, and up to 200 feet in length, depending upon their relative position in the paper machine. The surface speeds of these continuous fabric belts is normally in excess of 60 mph.

As should be understood, the paper machine fabric belts main job is to support the newly formed paper sheet and to remove water from the paper sheet in a very exact and consistent manner, thereby producing a clean and high quality sheet of paper. Those skilled in the art will recognize that forming belts must be fabricated from a woven forming fabric in such a fashion so as to provide a high quality surface. Such continuous forming belts must have a woven seam to join the fabric ends together in order to form a continuous belt.

In the process of forming this continuous forming belt, a first seam strip is cut off one of the ends of a forming fabric. Thereafter the weft threads or as sometimes called, cross machine threads are then removed from each of the fabric ends leaving the warp, or machine direction threads by themselves. These warp threads are typically supported and held in place by a seaming band. The seam strip is then prepared by removing the warp threads. This seam strip is now placed in an automatic seaming machine harness that is mounted to a jacquard head. Using the jacquard head to reproduce the exact same weave pattern as the fabric body, it is possible to recreate the weaving pattern and by using this seam strip, introduce the warp ends from each side of the fabric body to the seam strip using various insertion points where the two ends meet. Through this process it is possible to make the fabric endless, thereby forming a belt which is then later installed on a paper machine.

In the prior art process which is utilized heretofore, fabrics which will be used in continuous forming or dryer belts must first be prepared by removing weft threads from the seam area of the fabric. While various devices are currently in existence to automatically remove warp threads from the seam strip, the current methodology still requires that an operator, by hand, manually remove any remaining weft threads from the seam strip region. This is a very time consuming process. It also has a negative ergonomic impact on the operator who must maintain their body in a bent-over condition for many hours. This posture, of course, promotes back and shoulder pain and other discomforts.

While assorted devices and other methodology have been employed to try to reduce operator discomfort and increase the speed with which such endless fabric belts may be fabricated, such efforts have failed to produce a device which eliminates substantial operator involvement in the removal of weft threads from the edge of the fabric.

Therefore, an apparatus for removing weft threads from the edge of a fabric is the subject matter of the present application.

SUMMARY OF THE INVENTION

One aspect of the present invention relates to a method for removing weft threads from an edge of a fabric which includes the steps of engaging a first end of a weft thread which is to be removed from a forward edge of a fabric, and wherein the weft thread has an opposite second end; progressively separating the weft thread which is to removed from the forward edge of the fabric, and wherein the progressive separation extends in a direction from the first end of the weft thread to the second end thereof; and removing the weft thread which has been separated from the forward edge of the fabric.

Another aspect of the present invention relates to a method for removing weft threads from an edge of a fabric which includes the steps of providing a fabric having a forward edge, and opposite lateral edges, and wherein the fabric comprises both warp and weft threads; engaging a first end of a weft thread to be removed from the forward edge of the fabric, and wherein the first end is near one of the lateral edges of the fabric; moving the first end of the weft thread which has been engaged away from the forward edge of the fabric; imparting a longitudinally directed pulling force to the first end of the weft thread which has been engaged; progressively, forcibly separating the weft thread which has been engaged along its entire length from the forward edge of the fabric; and removing the separated weft thread from the fabric.

Still another aspect of the present invention relates to a method for removing a weft thread from an edge of a fabric which includes the steps of providing a fabric having a forward edge, and opposite lateral edges, and wherein the fabric comprises both warp and weft threads; displacing a first end of a weft thread which is to be removed from the forward edge of the fabric to a location which is in spaced relation relative to the forward edge of the fabric, and wherein the weft thread to be removed has an opposite second end; engaging the displaced first end of the weft thread and exerting a pulling force substantially longitudinally along the weft thread to be removed; providing a draw-off device which may be selectively energized, and securing the displaced first end within the draw-off device; providing a plurality of selectively actuated wedge assemblies which are oriented in substantially parallel relation relative to the forward edge of the fabric; sequentially moving the respective wedge assembly along an angulated path of travel relative to the fabric and through the warp threads thereof, and between the weft thread to be removed and the forward edge of the fabric so as to cause the weft thread to become spaced from the forward edge of the fabric; and energizing the draw-off device so as to remove the weft thread which has been separated from the forward edge of the fabric.

Yet a further aspect of the present invention relates to a weft thread removal apparatus which includes a bed for supporting a fabric which is manufactured from both warp and weft threads, and which further has a forward edge, and opposite lateral edges; a selectively rotatable draw-off device mounted adjacent to one of the lateral edges of the fabric and which forcibly engages a first end of a weft thread which is to be removed; and a plurality of wedge assemblies which are mounted on the bed, and which are selectively moveable relative to the forward edge of the fabric, and which facilitate the separation of the weft thread which has been engaged from the forward edge of the fabric.

A further aspect of the present invention relates to a weft thread removal apparatus which includes a bed having an upper supporting surface which supports a fabric which is manufactured from both warp and weft threads, and wherein the fabric further has a forward edge, and opposite lateral edges, and wherein the bed defines an aperture extending therethrough; an engagement assembly mounted on the bed and adjacent to one of the lateral edges of the fabric, and wherein the engagement assembly is reciprocally moveable along a path of travel which is substantially parallel to the warp threads, and wherein the engagement assembly when moving along the reciprocal path of travel engages a first end of a weft thread which is to be removed from the forward edge of the fabric, and displaces the first end to a location which is in spaced relation relative thereto; a moveable clamping assembly cooperating with the bed, and which engages the displaced first end of the weft thread to be removed and exerts a longitudinally oriented pulling force on the first end; a draw-off device which may be selectively energized, and which is positioned adjacent to the clamping assembly, and wherein the first end of the weft thread to be removed is secured within the draw-off device; a plurality of moveable wedge assemblies which are mounted below the upper supporting surface of the bed, and which can be selectively actuated so as to move along a reciprocal path of travel, and extend, at least in part, through the aperture defined by the bed, and facilitate the separation of the weft thread to be removed from the forward edge of the fabric which is supported on the bed; and a controller operably coupled to each of the plurality of the moveable wedges, and the draw-off device, and wherein the respective moveable wedges are first, individually sequentially moved so as to separate the weft thread from the forward edge of the fabric, and once separated, the controller energizes the draw-off device so as to remove the separated weft thread from the fabric.

These and other aspects of the present invention will be described in greater detail hereinafter.

BRIEF DESCRIPTION OF THE DRAWINGS

Preferred embodiments of the invention are described below with reference to the following accompanying drawings.

FIG. 6 is a fragmentary, top plan view of the apparatus which is useful in practicing the methodology of the present invention and which is shown in a third position.

FIG. 7 is a fragmentary, top plan view of a portion of the apparatus of the present invention and which is useful in practicing the methodology of the present invention and shown in a forth position.

FIG. 10 is a fragmentary, side elevation view of a portion of a controller assembly which finds usefulness in the apparatus and methodology of the present invention.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
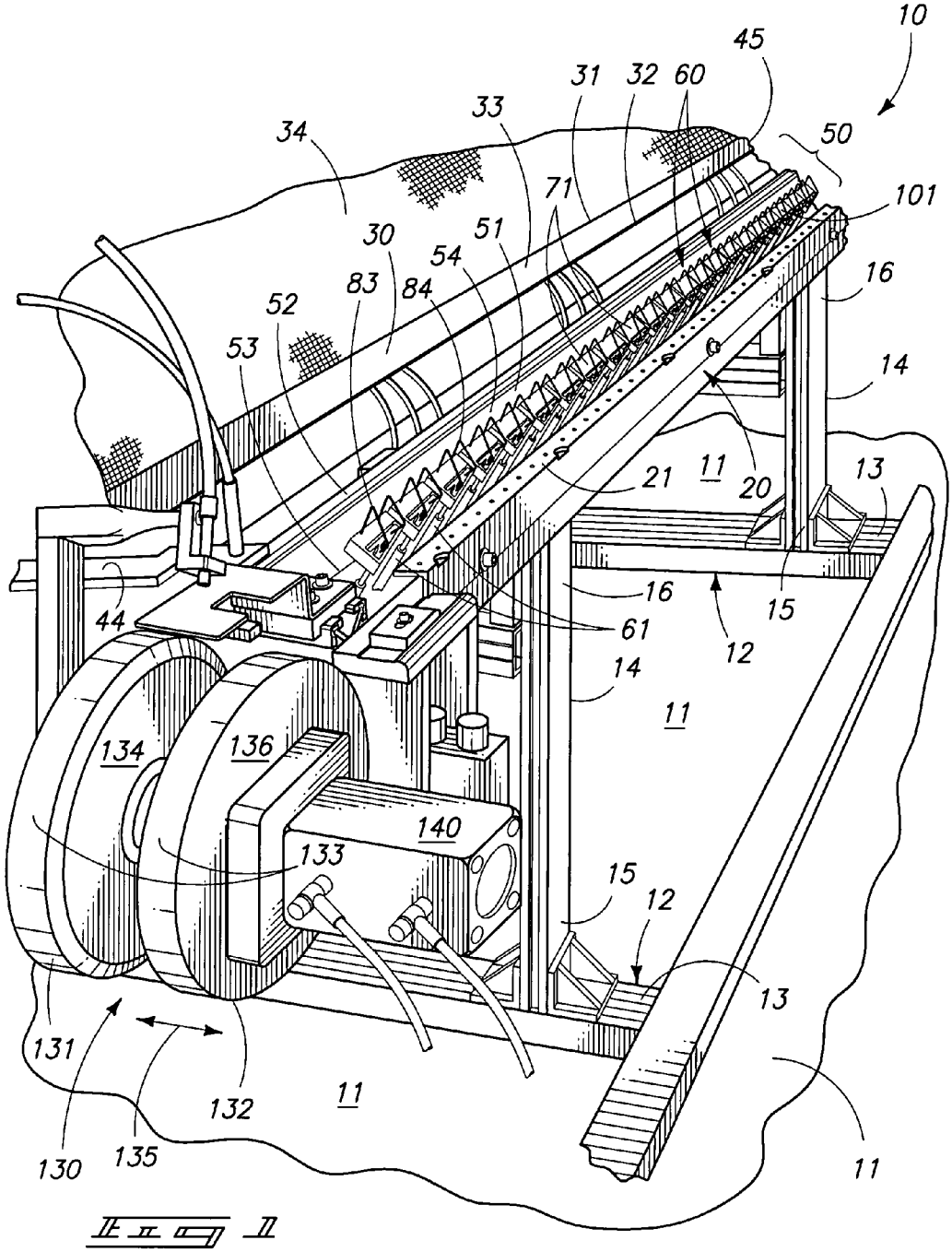
FIG. 1 is a fragmentary, perspective end view of an apparatus for practicing the methodology for removing weft threads from an edge of a fabric.

Referring more particularly to the drawings, the weft thread removal apparatus which is useful in practicing the methodology of the present invention is generally indicated by the numeral 10 in FIG. 1. As seen in FIG. 1, it will be understood that the apparatus of the present invention 10 is mounted in a fixed position on a supporting surface, such as the surface of the earth 11 by means of a base member which is generally indicated by the numeral 12. The base member 12 is made up of a multiplicity of members which are joined together by fasteners, welding or the like. The base member 12 has an upwardly facing surface 13. Attached to and extending normally upwardly relative to the upwardly facing surface 13 of the base member 12 is a plurality of vertically oriented supporting legs 14. Each of the supporting legs 14 have a first end 15 which is attached to the base member 12 by welding, or the like, and a second or opposite end 16 which is remote thereto. Referring still to FIG. 1, it will be seen that mounted to the distal, second end 16 of the respective vertically oriented supporting legs 14 is a horizontal support member which is generally indicated by the numeral 20. This horizontal support member 20 has an upwardly facing surface 21 upon which the fabric, which will be described hereinafter, will be supported, at least in part.

Figure 2:
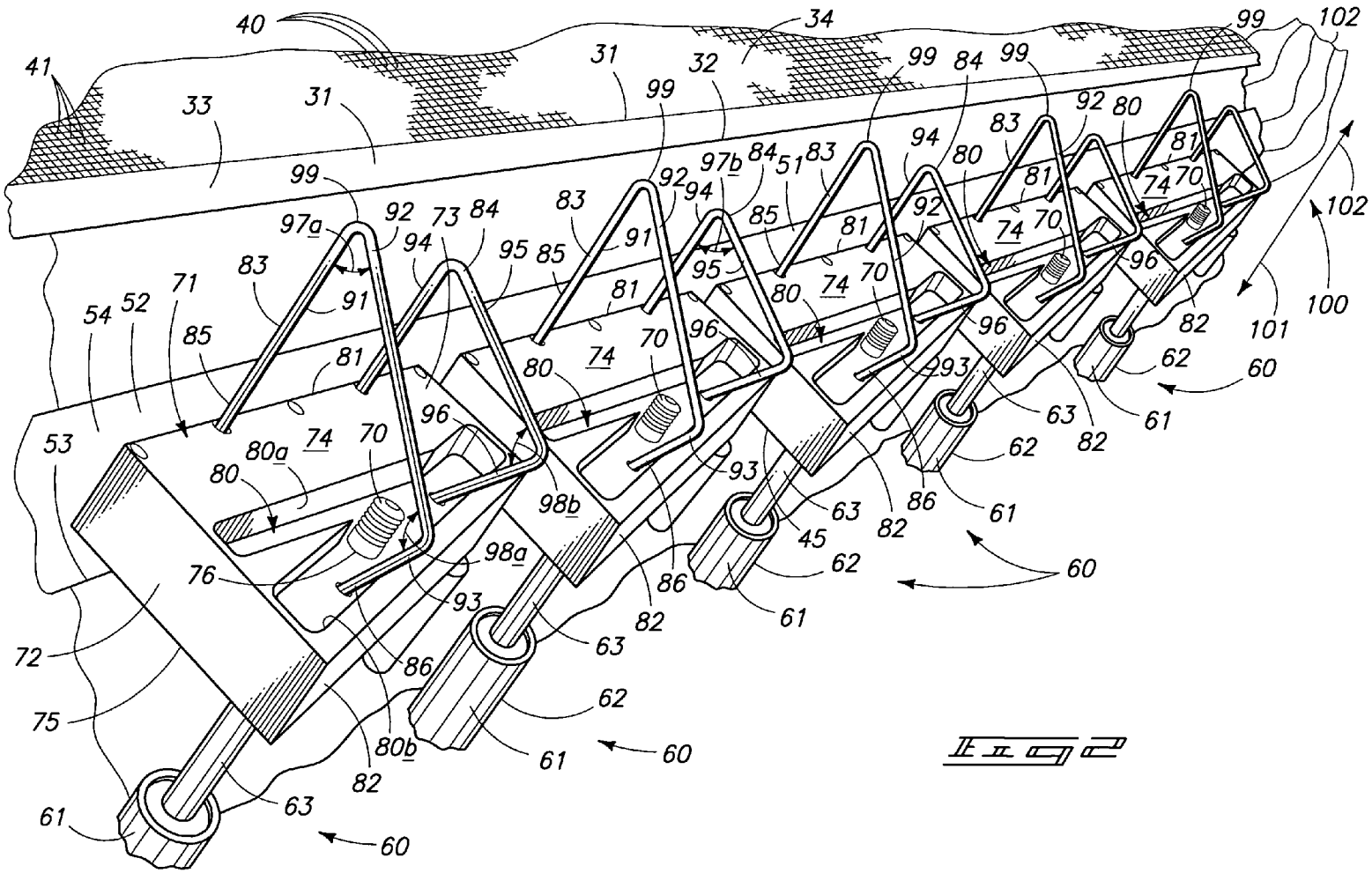
FIG. 2 is a fragmentary, greatly enlarged, perspective view of a plurality of wedge assemblies which are useful for practicing, at least in part, the methodology of the present invention.
Figure 3:
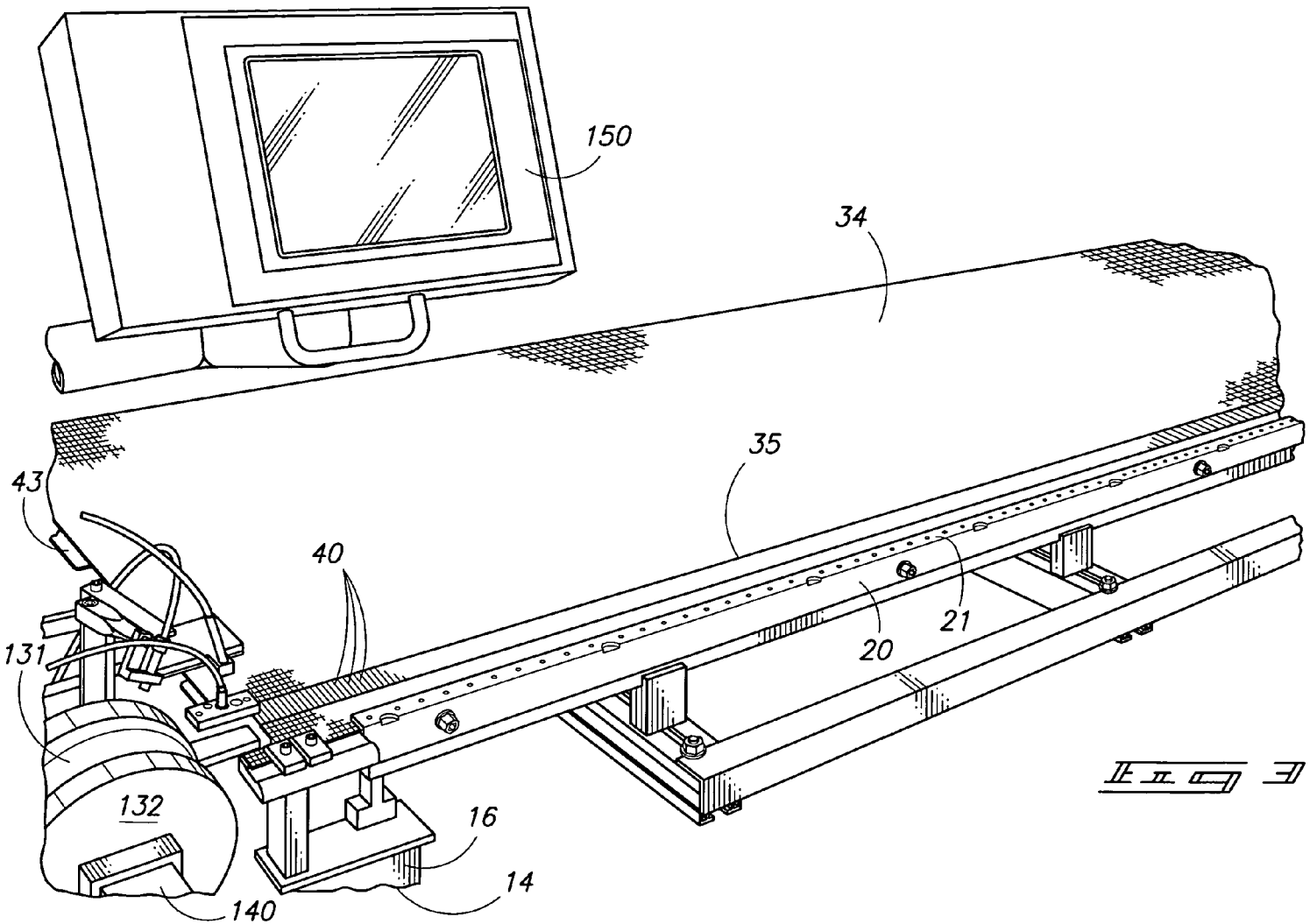
FIG. 3 is a perspective, fragmentary, side elevation view of the apparatus for practicing the methodology of the present invention.
Figure 4:
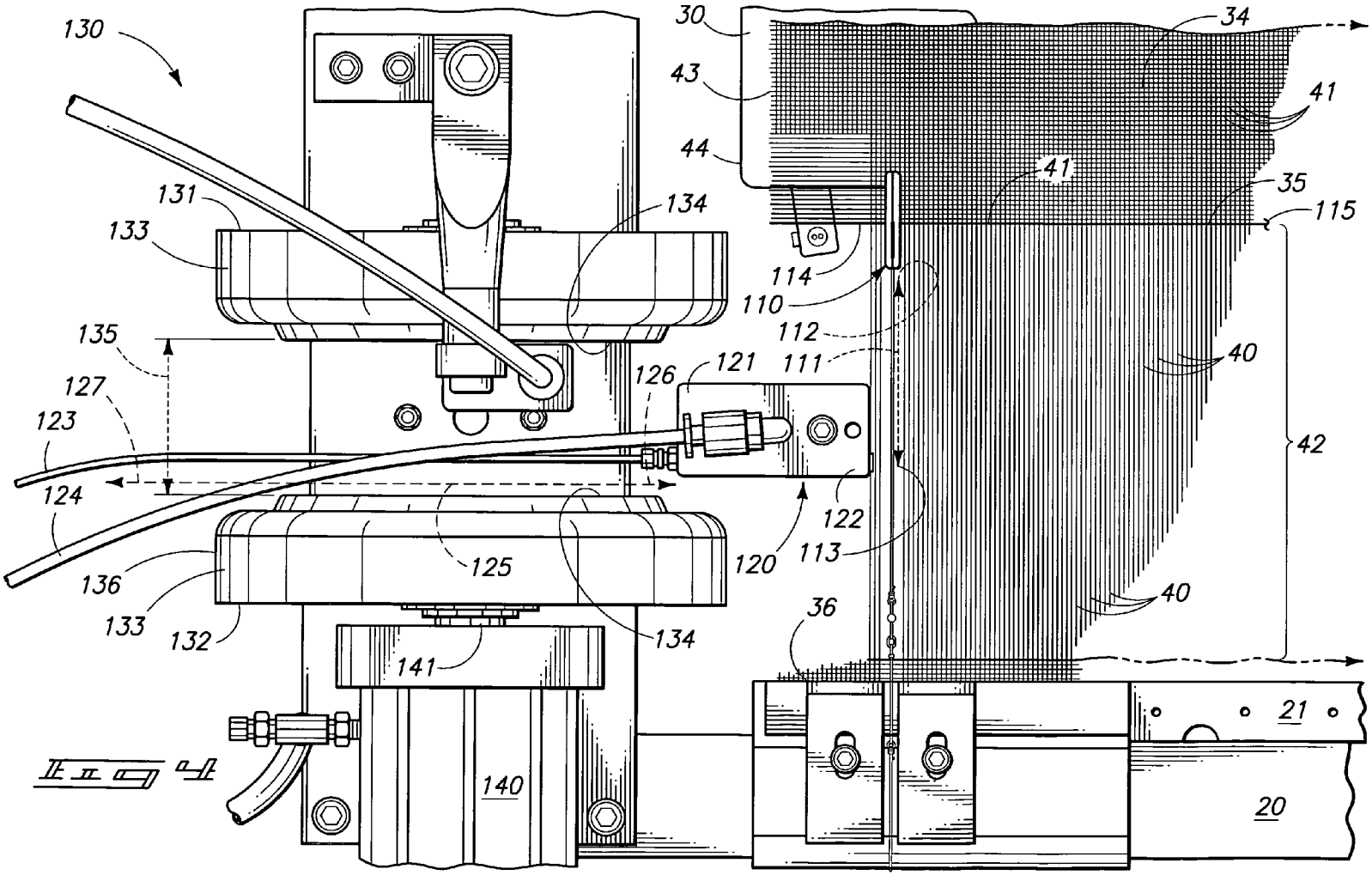
FIG. 4 is a fragmentary, top plan view of a portion of the apparatus for practicing the methodology of the present invention and which is shown in a first position.
Figure 5:
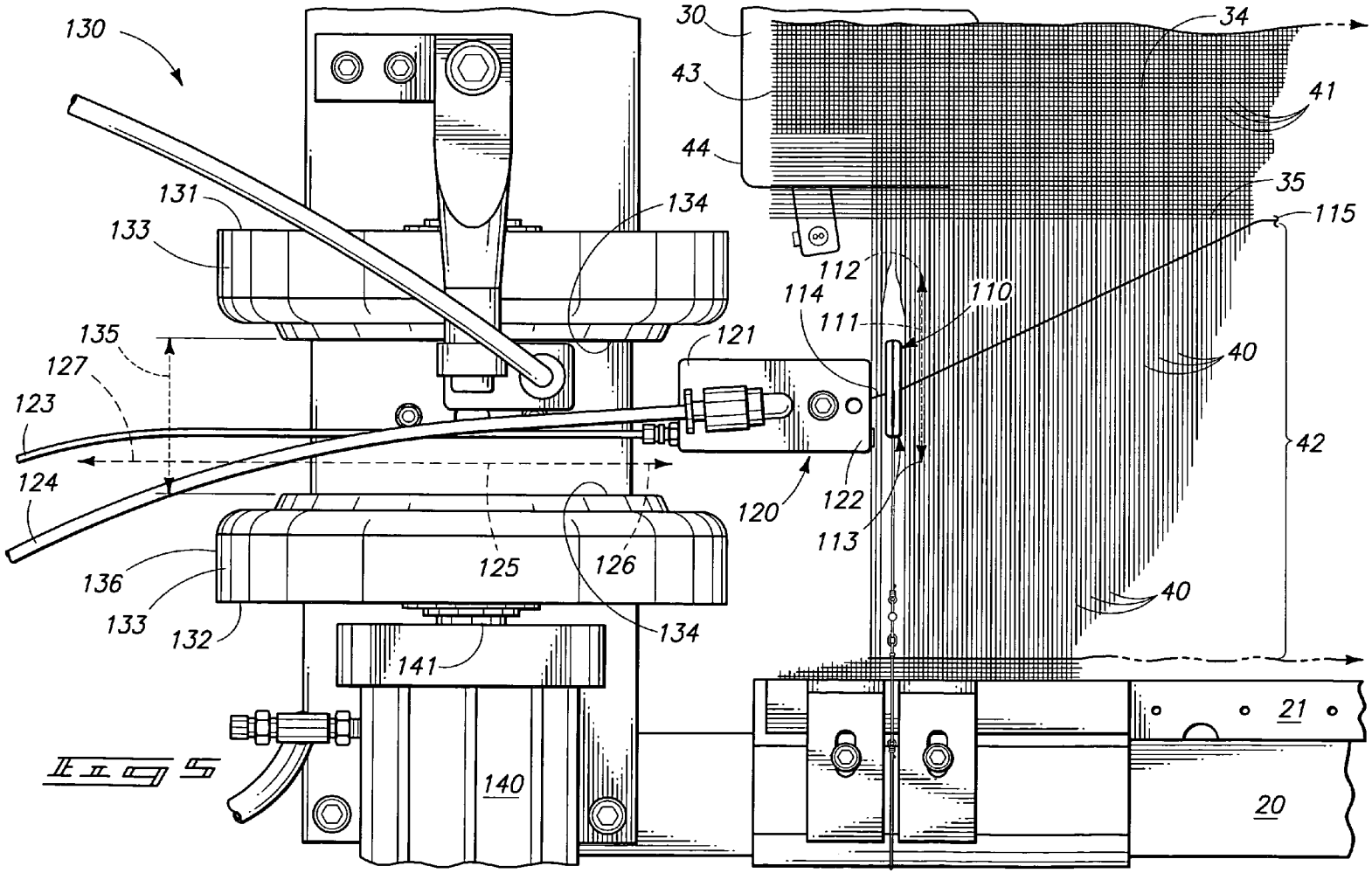
FIG. 5 is a fragmentary, top plan view of the apparatus which is useful in practicing the methodology of the present invention and which is shown in a second position.
Figure 11:
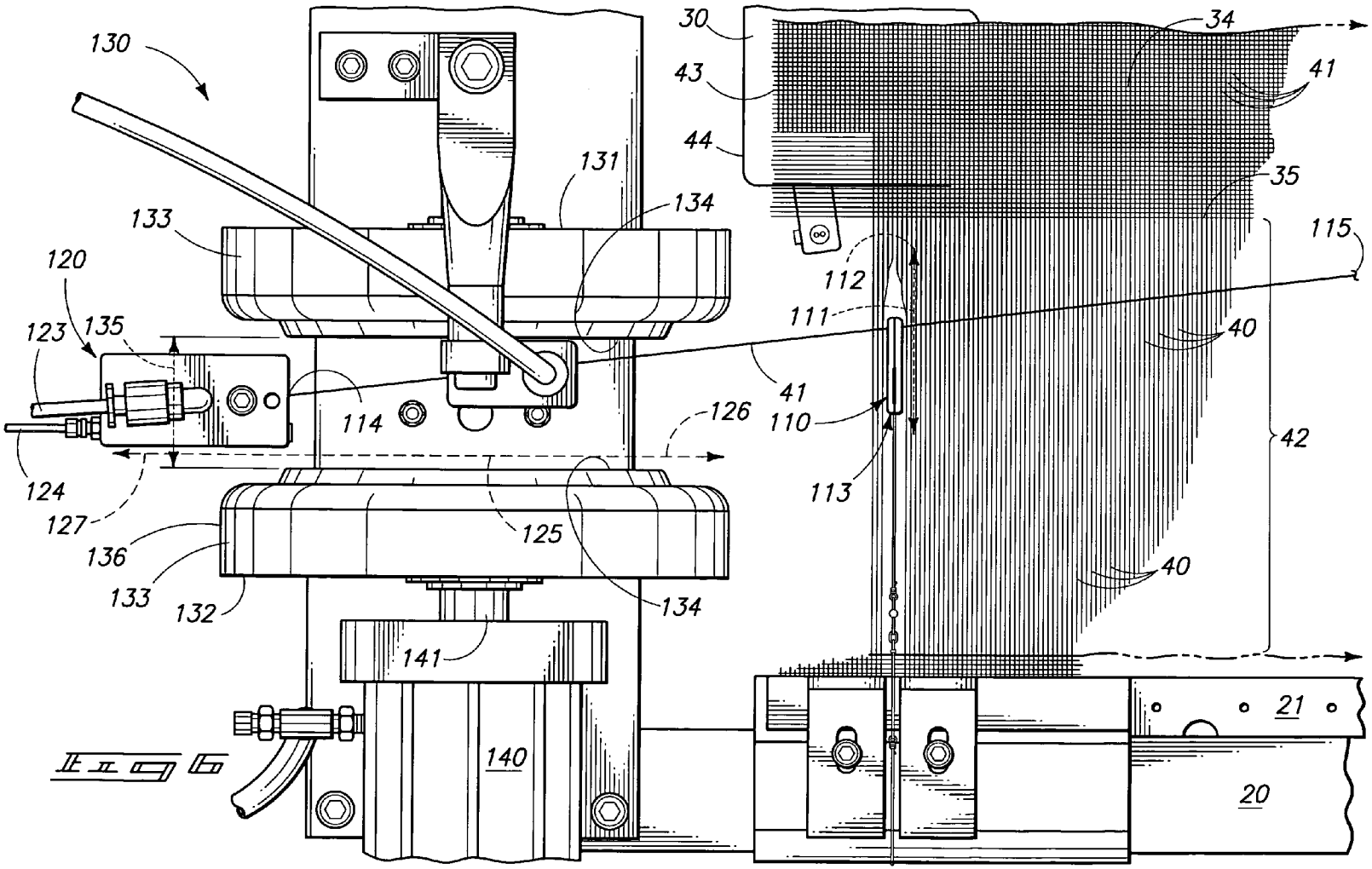
Figure 11:
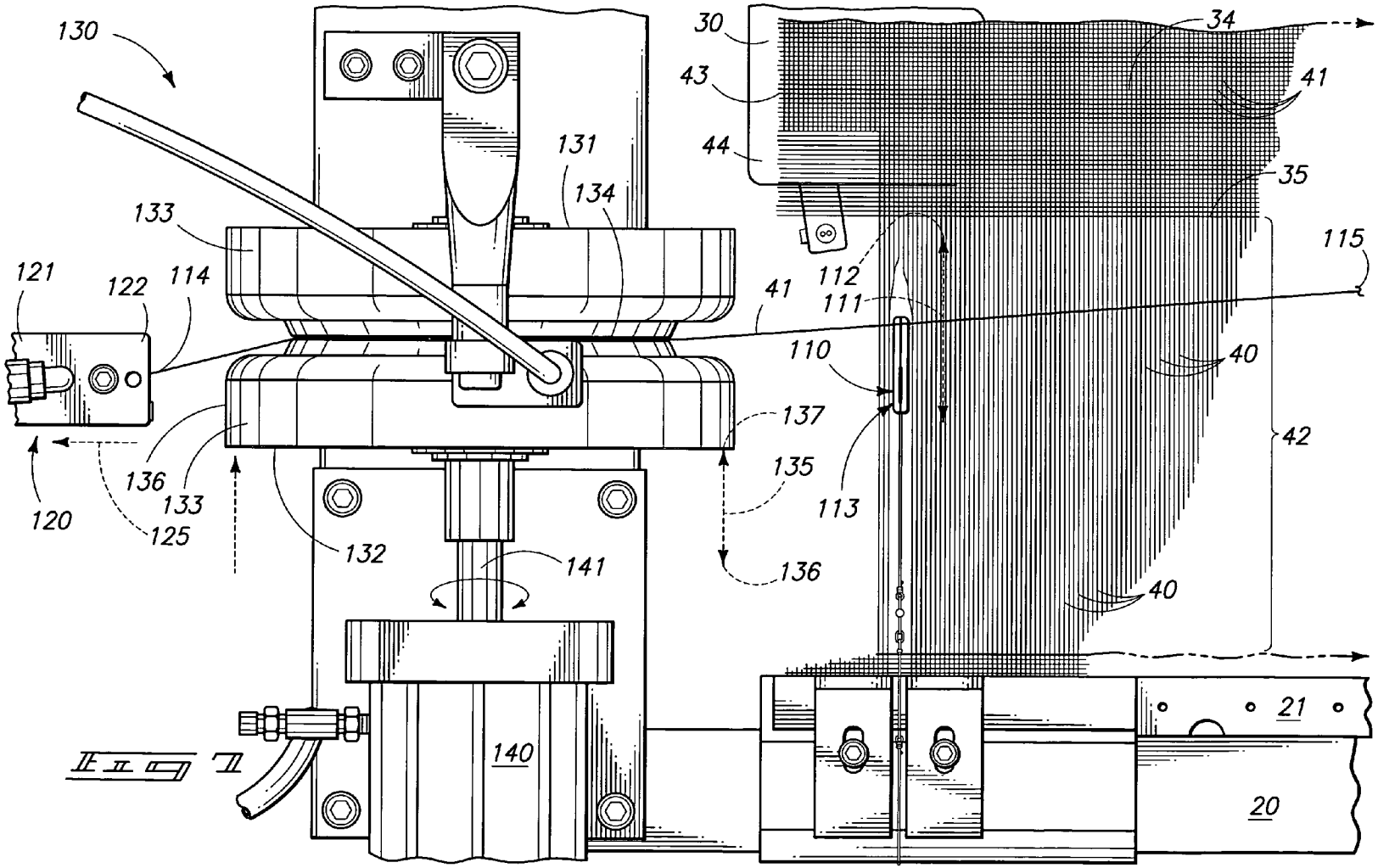

The fabric, as first mentioned, above, is placed onto a supporting bed which is generally indicated by the numeral 30, and which is further disposed in horizontally spaced relationship relative to the support member 20. The supporting bed 30 has a top surface 31 upon which the fabric is placed and supported. Still further, the supporting bed has an opposite, bottom surface 32 (FIG. 2) which is disposed in spaced relation relative to the supporting surface, or the surface of the earth 11. The supporting bed 30 further has a leading edge 33 which is disposed in spaced relation relative to the horizontal support member 20. A fabric 34 is placed onto the supporting bed and the leading edge 35 of the fabric, as seen in FIGS. 3 and 5, is oriented between the leading edge 33 of the supporting bed 30, and the horizontal support member 20. As best seen in the later drawings, it should be understood that the fabric 34, having the leading or forward edge 35 is formed of a plurality of warp threads 40, and a plurality of weft threads which are generally indicated by the numeral 41. As illustrated in FIG. 4 and following, the fabric 34 has a region 42, which is formed by the apparatus 10 and which will become the location where the opposite ends of the fabric 34 will be later joined together in order to make a continuous fabric belt. The present apparatus 10 provides a means and methodology by which weft threads 41 are removed from the forward edge 35 of the fabric 34 to form this region 42, in order to facilitate the formation of a continuous fabric belt which may subsequently be installed in a paper machine as earlier described. As illustrated in the drawings, one end 36 of the fabric 34 is secured to the horizontal supporting member 20, and the apparatus and methodology 10, as later described, facilitates the removal of the weft threads 41 from the leading or forward edge 35 of the fabric 34 in order to form the region 42 as illustrated in FIG. 4 and following. The fabric 34, as illustrated has a lateral edge 43 which is disposed at the first end 44 of the supporting bed 30. It should be understood that the supporting bed 30 has an opposite second end 45.

A gap or aperture 50 (FIG. 1) is defined between the leading edge 33 of the supporting bed 30, and the horizontal supporting member 20. Positioned within this gap or aperture 50 is a second horizontal support member which is generally indicated by the numeral 51 (FIG. 2). The second horizontal support member has a top surface 52, and an opposite bottom surface 53 which is disposed in spaced relationship relative to the supporting surface or surface of the earth 11. Still further, the horizontal support member 50 is defined, at least in part, by a sidewall 54 (FIG. 1). Mounted in predetermined positions along the second horizontal support member 50 are a plurality of wedge assemblies 60 (FIG. 2) which are selectively actuatable, and moveable relative to the leading or forward edge of the fabric 34, and which facilitates the separation of a weft thread 41 which has been engaged by the plurality of wedge assemblies, from the forward edge 35 of the fabric 34. This is best illustrated by reference to FIGS. 8 and 9, for example.

Each wedge assembly 60 includes a pneumatic cylinder which is generally indicated by the numeral 61. The pneumatic cylinder is defined by a cylinder body 62 (FIG. 10) which mounts a movable ram which is generally indicated by the numeral 63. Coupled in fluid flowing relation relative to each of the pneumatic cylinders 61 is a pair of air conduits 64. The air conduits are coupled in fluid flowing relation relative to a pneumatic distributor/controller 65. The distributor/controller 65 is, in turn, controllably coupled to a controller which will be discussed in greater detail hereinafter. Each of the rams 63 has a distal end 70. Releasably mounted on the distal end of each of the rams is a base portion 71. Each base portion has a first end 72, and an opposite second end 73. Still further, the respective base portions each have a top surface 74, and an opposite bottom surface 75. As seen most clearly by reference to FIG. 2, a passageway 76 is formed in the base portion 71 and is operable to matingly couple with the distal end 70 of the respective rams 63.

Figure 8:
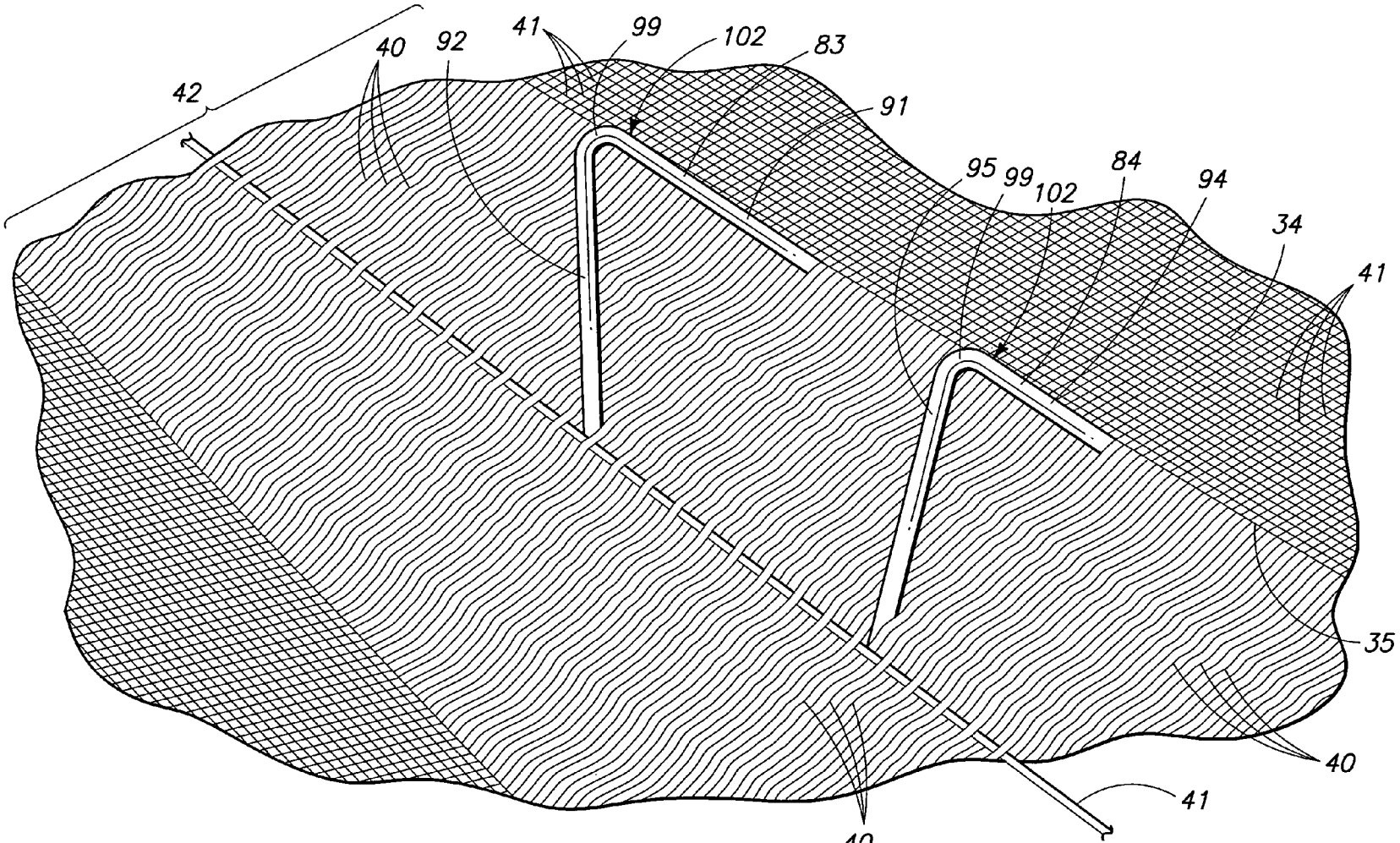
FIG. 8 is a greatly enlarged, perspective, top plan view of the invention and showing a portion of a wedge assembly which is oriented in engagement with a fabric which is being processed by the apparatus of the present invention.

Referring more specifically to FIG. 2, it will be seen that a channel 80 is formed in the top surface 74 of the base portion 71. It will also be seen that the base portion 71 has a first lateral edge 81, and an opposite, second laterally disposed edge 82. The first and second lateral edges 81 and 82 extend between the first and second ends 72 and 73. The channel 80 is defined between spaced sidewalls (80*a* and 80*b*) and is further located adjacent to the second lateral edge 82 of the base portion 71. In the arrangement as seen in the drawings, the respective wedge assemblies 60 each have first and second reeding elements which are generally indicated by the numerals 83, and 84, respectively. The first and second ends of the respecting reeding elements 85 and 86, are each mounted in a fixed position on the upper facing surface 74 of the base portion 71. In one form of the invention, which is not shown, the second end 86 of the respective first and second reeding elements 83 and 84 is moveable along a path of travel which is defined by the base portion 71 and more specifically the channel 80 formed therein. As illustrated most clearly by reference to FIG. 2, each of the reeding elements 83 and 84 have first, second and third courses herein indicated by the numerals 91, 92 and 93, respectively, for the first reeding element 83; and 94, 95 and 96 for the second reeding element 84. As seen, in the drawings, the first reeding element 83 is located in spaced relation relative to the first end 72 of the wedge assembly 60, and the second reeding element 84 is located in spaced relation relative to the second end 73 of the wedge assembly 60. Upon close inspection of the drawings, it will be recognized that the first and second courses 91 and 92 of the first reeding element 83 have a length dimension which are longer than the first and second courses 94 and 95 of the second reeding element 84. Still further, the third course 93 of the first reeding element 83 has a length dimension which is shorter than the third course 96 of the second reeding element 84. Additionally, it will be noted that a first angle 97*a* and 97*b* is defined between the first and second courses 91 and 92; and 94 and 95 of each of the first and second reeding elements 83 and 84, respectively. Still further, a second angle 98*a* and 98*b* is defined between the second and third courses 92 and 93, and 95 and 96 of each of the first and second reeding elements 83 and 84. As will be understood, the first angle 97*a* of the first reeding element 83 is less than the first angle 97*b* of the second reeding element 84. Still further, the second angle 98*a* of the first reeding element 83 is greater than the second angle 98*b* of the second reeding element 84. As discussed above, and in one form of the invention, the first and second ends 85 and 86 of the first and second reeding elements 83 and 84 are securely fastened to the base portion 71. In another form of the invention, just the first end is attached firmly to the base portion 71 and the second end 86 is moveable within the channel 80 along a course of travel which is defined between the sidewalls 80*a* and 80*b* of the channel. As will be seen from the drawings, each of the reeding elements 83 and 84 has an apex 99 which is operable to penetrate through the warp threads 40 and between weft threads 41 at the leading or forward edge 35 of the fabric 34 in order to facilitate the separation of a weft thread 41 from the forward edge 35 of the fabric 34 (FIG. 8). This facilitates, at least in part, the removal of the weft thread 41 from the region 42 which is being formed by the apparatus 10.

As should be understood the respective wedge assemblies 60 are reciprocally moveable along an angulated path of travel 100 (FIG. 2) from a first position 101 whereby the respective wedge assemblies are positioned below the top surface 31 of the supporting bed, and below the fabric 34, to a second, extended position 102 (illustrated best in FIG. 8), and whereby the apex 99 of the first and second reeding elements 83 and 84 penetrate the warp threads 40 and pass between adjacent weft threads 41 forming the leading or forward edge 35 of the fabric 34 thereby effectively and forcibly separating or otherwise spacing the weft thread 41 from the forward edge 35 so as to facilitate the removal of same. As will be seen in the drawings, the reciprocal path of travel 100 is angulated or in a non-perpendicular orientation relative to the fabric 34. Still further, it should be understood that the respective wedge assemblies 60 are selectively actuated so as to move along a reciprocal path of travel 100 in a sequential, cascading manner through the gap or aperture 50 which is defined, at least in part, by the bed 30. This action of the respective wedge assemblies 60 facilitates the separation of the weft thread 41 to be removed from the forward edge 35 of the fabric 34 which is supported on the bed 30. This sequential, cascading operation of the respective wedge assemblies is effected by a controller which will be discussed in greater detail hereinafter.

Referring now to FIG. 4-7, it will be seen that the weft thread removal apparatus and methodology 10 for removing a weft thread 41 from the forward edge 35 of a fabric 34 includes a moveable engagement assembly 110 which is mounted on the supporting bed 30 and which is located adjacent to one of the lateral edges 43 of the fabric 34. In the arrangement as seen in FIG. 4 and following, the engagement assembly 110 is received, at least in part, between adjacent warp threads 40 in the region 42. The engagement assembly 110 is reciprocally moveable along a path of travel 111 between first and second positions 112 and 113, respectively, and which is substantially parallel to the warp threads 40. When the engagement assembly 110 moves along the reciprocal path of travel 100, it comes into contact with and then engages a first end 114 of a weft thread 41 which is to be removed from the forward edge 35 of the fabric 34 when located in the first position 112 (FIG. 4), and then displaces the first end 114 of the weft thread 41 along the path of travel to the second position 112, and which is in spaced relation relative thereto (FIG. 5). Therefore, in the present methodology, the method broadly includes the steps of providing a moveable engagement assembly 110, and positioning the engagement assembly between a plurality of warp threads 40 of the fabric 34, and reciprocally moving the engagement assembly 110 into and out of engagement with the forward edge 35 of the fabric 34 thereby causing the displacement of a first end 114 of a weft thread 41 which is to be removed from the forward edge 35 to a location which is in spaced relation relative to the forward edge 35 of the fabric 34. The reciprocal path of travel 111, as noted above, is defined between a first position 112, as seen in FIG. 4 whereby the engagement assembly 110 is positioned where it engages the first end 114 of the weft thread 41 to be removed; and thereafter moves to a second position 113, which is disposed in spaced relationship relative to the first position 112, and whereby the first end 114 of the weft thread 41 to be removed is displaced to a location in spaced relation relative to the forward edge 35 of the fabric 34. As should be understood, the weft thread 41 to be removed has a first end 114 and an opposite second end 115. As seen in the drawings, the engagement assembly 110 is reciprocally moveable along the path of travel 111. This path of travel is substantially parallel to the warp threads 40 which are located in the region 42 of the fabric 34. The operation of the engagement assembly is well understood in the art and further discussion regarding same appears unwarranted.

Referring still to FIGS. 4-7, it will be seen that the method and apparatus for removing weft threads from the edge of a fabric 10 further comprises a moveable clamping assembly which is generally indicated by the numeral 120 and which moves reciprocally relative to the supporting bed 30. The moveable clamping assembly is operable to engage the displaced first end 114 of the weft thread 41 to be removed and exert a substantially longitudinally oriented pulling force on the first end 114. As seen in FIG. 4 and following, it will be appreciated that the moveable clamping assembly 120 includes a main body 121 which is operable to releasably engage the first end of the weft thread 114 to be removed. In this regard, the main body 121 includes a moveable jaw 122, only one part of which is shown. Still further, and coupled to the main body 121, is an electrical conduit 123 which carries electrical conductors which facilitate the operation of the clamping assembly 120. Additionally, it will be seen that a pneumatic conduit 124 is coupled in fluid flowing relation relative to the main body 121 and is operable to operate the jaw 122 so as to enable the jaw to appropriately clamp or otherwise releasably engage the first end of the weft thread 114 in the main body 121 thereby securing the first end of the weft thread 114 within the jaw. As understood by a study of FIG. 4 and following, the clamping assembly 120 is moveable along a path of travel 125 between first and second positions 126 and 127, and which is further substantially parallel to the weft threads 41 of the fabric 34, and is additionally substantially perpendicular to the reciprocal path of travel 111 of the engagement assembly 110 which was discussed in the paragraph above. As best seen in FIGS. 5, 6 and 7, once the first end 114 of the weft thread 41 to be removed is engaged by the clamping assembly 120 when located in the first position 126, the main body 121 moves along the path of travel 125 to the second position 127 so as to provide the earlier described substantially longitudinally directed pulling force to the weft thread 41 to be removed so as to position the first end 114 of the weft thread 41 to be removed in an appropriate orientation relative to a draw-off device 130, as will be described below, so that it may engage same. As will be understood from the discussion which follows, the draw-off device, when energized acts, in part, to remove the weft thread 41 to be removed as the respective wedge assemblies 60 are energized in a sequential, cascading manner thereby forcibly separating the weft thread 41 to be removed from the forward edge 35 of the fabric 34.

Referring still to FIGS. 4-7 it will be seen that the present apparatus and the method associated with same 10 includes a draw-off device 130 which may be selectively energized and which is positioned adjacent to and cooperates with the moveable clamping assembly 120. As discussed briefly, above, the first end 114 of the weft thread 41 to be removed is releasably secured within the draw-off device 130 once the clamping assembly 120 has been moved along the path of travel 125 and into the second, position 127. As seen in FIGS. 4-7, the second position 127 is oriented in spaced relation relative to the lateral edge 43 of the fabric 34. Further, and as seen in FIG. 4 and following, the draw-off device 130 which is positioned adjacent to the lateral edge 43 of the fabric 34 includes a rotatable first portion 131 which is fixed in a given location relative to the edge 43 of the fabric, and a rotatable and moveable second portion 132 which is positioned in spaced relation relative thereto. Each of the first and second portions are substantially circular in their cross-sectional shape, and each are defined by a substantially circular peripheral edge 133. Still further, each of the first and second portions 131 and 132 has an inside facing surface 134, which, when moved together, is operable to capture the first end 114 of the weft thread 41 to be removed therebetween. As best understood by a study of FIGS. 6 and 7, for example, the first and second portions 132, and more specifically the second portion 132 thereof, moves along a path of travel 135, from a first position 136, whereby the second portion 132 is positioned in spaced relation relative to the first portion 131 (FIG. 4); and a second position 137 (FIG. 7), whereby the second portion is moved into adjacent, juxtaposed, force engaging relation thereagainst the first portion 131. When the first and second portions 131 and 132 are disposed in juxtaposed relation as seen in FIG. 7, the first end 114 of the weft thread 41 to be removed is captured or otherwise secured therebetween the inside facing surfaces 134 of the first and second portions 131 and 132, respectively. As best illustrated in FIGS. 6 and 7, a selectively energizeable motor 140 is provided and which is disposed in driving relation relative to the second portion 132. The selectively energizeable motor has a selectively extendible engine shaft 141 which carries the second portion 132 along the path of travel 135 so as to position the second portion 132 in juxtaposed, force engaging relation thereagainst the first portion 131. Once the selectively energizeable motor 140 is energized it synchronously rotates the first and second portions 131 and 132, which are in juxtaposed, friction engaging relation so as to continuously exert a longitudinally directed pulling force to the weft thread 41 to be removed. The rotation of the first and second portions is effective to wind up and thus remove the weft thread 41 which has been forceably separated from the forward edge 35 of the fabric 34 by the subsequent and synchronous cascading movement and action of the plurality of wedge assemblies 60 which were earlier described.

As best seen in FIG. 3, the apparatus and associated method 10 includes a controller 150 which is operably controllably coupled to each of the plurality of wedge assemblies 60; engagement assembly 110; moveable clamping assembly 120; and draw-off device 130. The controller 150 is operable to coordinate the various assemblies which were earlier described above in such a fashion that once the first end 114 of weft thread 41 to be removed is appropriately positioned and is otherwise engaged by the draw-off device 130, the respective moveable wedges 60 are first individually, sequentially moved along their respective paths of travel 100 so as to separate the weft thread 41 from the forward edge 35 of the fabric edge 34. Substantially simultaneously, the controller energizes the draw-off device 130 by means of the selectively energizeable motor 140 so as to cause a continuous longitudinal pulling force to be applied to the weft thread 41 which is to be removed. The combined action of the respective wedge assemblies 60 and the draw-off device 130, in combination has the effect of removing the separated weft thread 41 from the fabric 34.

As discussed above, and referring generally to FIGS. 1-10, a weft thread removal apparatus and the method 10 is shown. As seen in these drawings, the weft thread removal apparatus 10 includes a bed 30 having an upper supporting or top surface 31 which supports a fabric 34 which is manufactured from both warp and weft threads 40 and 41, respectively. The fabric 34 further has a forward edge 35, and opposite lateral edges 43. Still further, the bed 30 defines a gap or an aperture 50 extending therethrough. An engagement assembly 110 is provided and which is mounted on the bed 30 and adjacent to one of the lateral edges 43 of the fabric 34. The engagement assembly 110 is reciprocally moveable along a path of travel 111 which is substantially parallel to the warp threads 40. Still further, the engagement assembly 110 when moving along the reciprocal path of travel 111 engages a first end 114 of a weft thread 41 which is to be removed from the forward edge 35 of the fabric 34, and displaces the first end 114 to a location which is in spaced relation relative thereto. This is most clearly seen by reference to FIGS. 4 and 5, respectively. A moveable clamping assembly 120 is provided and which cooperates or is otherwise moveable relative to the bed 30, and which engages the displaced first end 114 of the weft thread 41 to be removed and exerts a longitudinally oriented pulling force on the first end. Still further, a draw-off device 130 is provided and which may be selectively energized, and which is positioned adjacent to the moveable clamping assembly 120. As seen in the drawings, the first end 114 of the weft thread 41 to be removed is secured within the draw-off device 130 when the first and second portions 131 and 132 are moved into engagement, one with the other. A plurality of wedge assemblies 60 are provided and which are mounted below the upper supporting surface 31 of the bed 30, and which can be selectively actuated by the controller 150 and 65 so as to move along a reciprocal path of travel 100, and extend, at least in part, through the aperture 50 which is defined, at least in part, by the bed 30. The sequential and cascading action of the respective wedge assemblies 60 facilitates the separation of the weft thread 41 to be removed from the forward edge 35 of the fabric 34 which is supported on the bed 30. A controller 150 is provided and which is controllably coupled to each of the plurality of the wedge assemblies 60, and the draw-off device 130, as well as the movable clamping assembly 120 and the engagement assembly 110 as described, above. In the arrangement as seen in the drawings, the respective moveable wedge assemblies 60 are first, individually sequentially moved so as to separate the weft thread 41 from the forward edge 35 of the fabric 34, while the controller simultaneously energizes the draw-off device 130 so as to exert continuous longitudinally directed pulling force on the weft thread 41 and then remove the separated weft thread 41 which had previously formed the leading or forward edge of the fabric 35 from the fabric 34.

Figure 9:
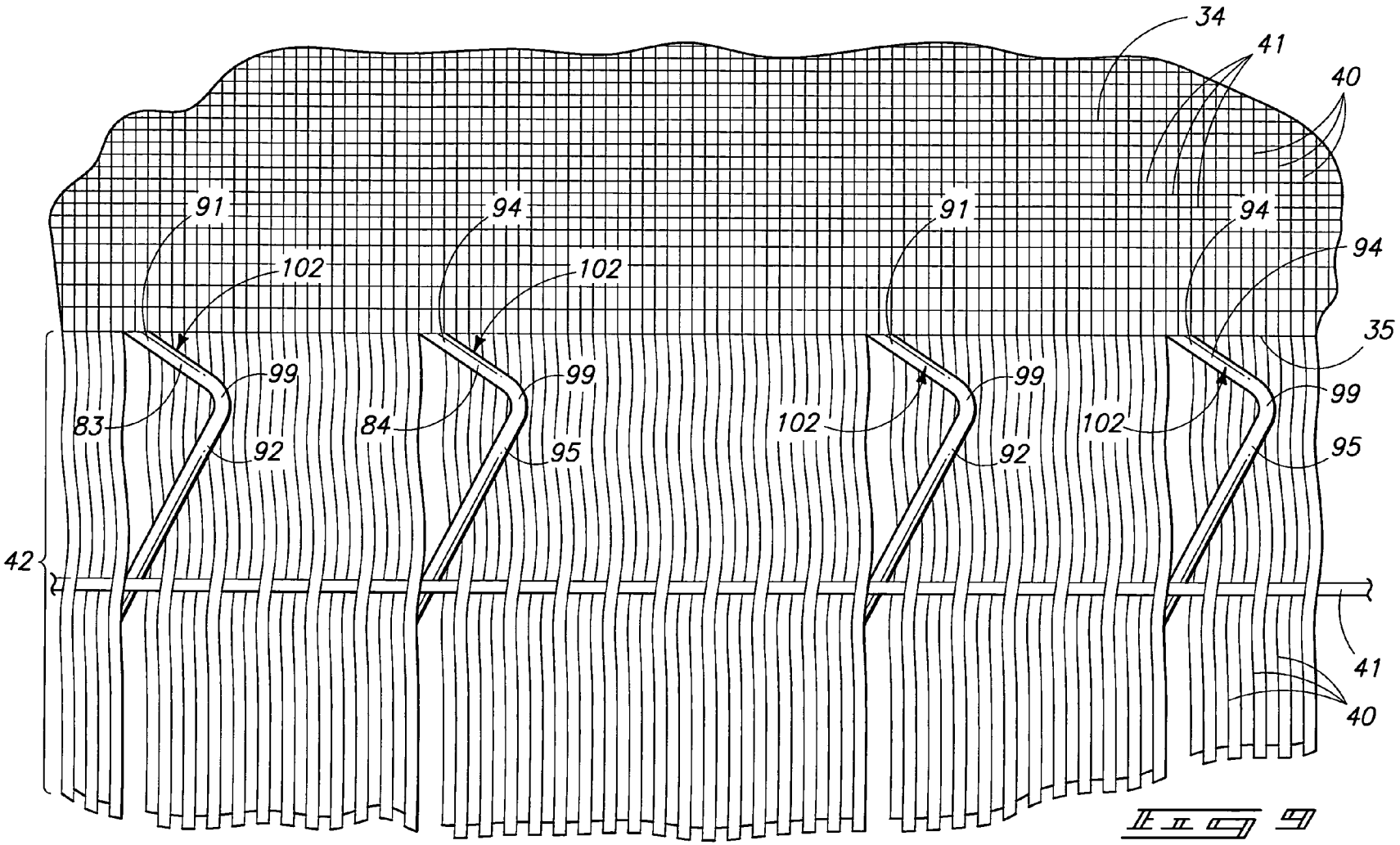
FIG. 9 is a second, perspective, top plan view of the invention, and showing a portion of the wedge assemblies of the present invention engaging a fabric which is being processed by the apparatus.
Figure 11:
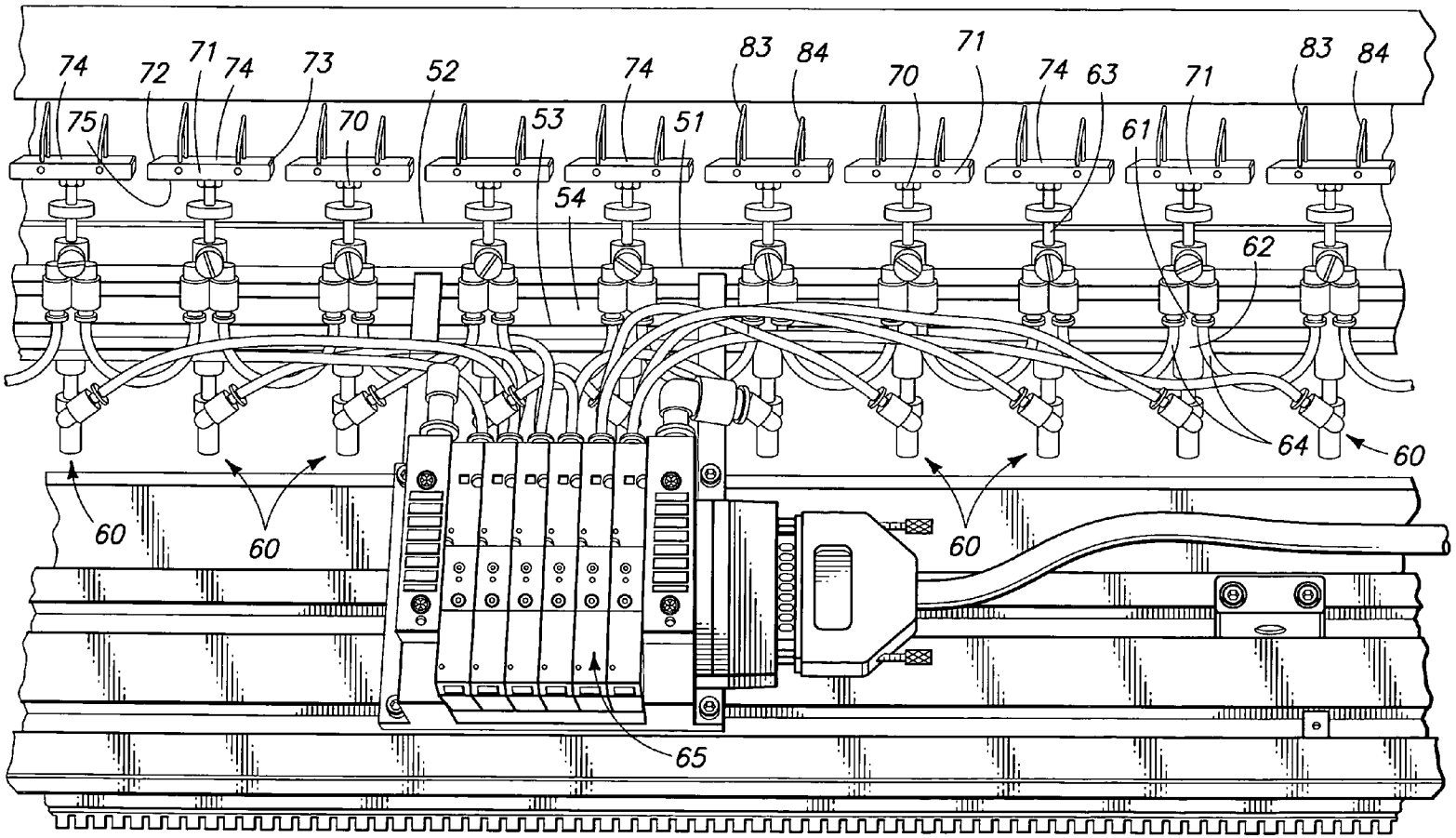

As earlier described, the engagement assembly 110 is reciprocally moveable within the gap or aperture 50 which is defined by the bed 30, and further extends, at least in part, through a plurality of warp threads 40 of the fabric 34 and which extend from the forward edge 35 of fabric 34 and span across the aperture 50 as defined by the bed 30 (FIGS. 8 and 9). Still further, the clamping assembly 120 is reciprocally moveable along a path of travel 125 which is substantially parallel to the weft threads 41 of the fabric 34, and perpendicular to the reciprocal path of travel 111 of the engagement assembly 110. In the arrangement as seen in the drawings, the draw-off device 130 further includes a first portion 131; a second portion 132; and means for moving the first and second portions, one relative to the other. The means for moving the first and second portions, one relative to the other, comprises, in part, a selectively energizeable motor 140 which, when energized, synchronously rotates the first and second portions 131 and 132. In this regard, the controller 150 causes the first and second portions 131 and 132 to move together by means of a selectively extendible engine shaft 141 so as to capture the first end 114 of the weft thread 41 to be removed therebetween the first and second portions 131 and 132 of the draw-off device 130. Still further, the controller 150 is operable to energize the draw-off device 130 in such a manner that the first and second portions 131 and 132, respectively synchronously rotate so as to roll up or otherwise remove the weft thread 41 which has been forcibly separated from the forward edge 35 of the fabric 34 by the cascading, synchronous movement of the respective wedge assemblies 60. In particular and referring specifically to FIGS. 4-7, it will be understood that the clamping assembly 120 is reciprocally moveable along a path of travel 125 which extends between the first and second portions 131 and 132 of the draw-off device 130 when the first and second portions are oriented in spaced relation, one relative to the other (FIG. 4). Still further, it will be understood that the longitudinally directed pulling force exerted by the clamping assembly 120 on the first end 114 of the weft thread 41 to be removed is effective for drawing the weft thread 41, at least in part, between and through the spaced first and second portions 131 and 132 of the draw-off device 130 prior to the first and second portions moving together so as to capture the first end 114 of the weft thread 41 to be removed therebetween the first and second portions of the draw-off device 130 (FIGS. 6 and 7).

It will be seen from the drawings that the wedge assemblies 60 each include a base portion 71 having an upper and a lower facing surface 74 and 75, respectively. Still further, a plurality of reeding elements 83 and 84, respectively are mounted in spaced relation on the upper facing surface 74 of the base portion. The moveable reeding elements 83 and 84 each have a different height and width dimension. In this regard, each of the reeding elements 83 and 84 has a first end 85, and an opposite second end 86. In the arrangement as seen in the drawings, the first and second ends 85 and 86 of the respective reeding elements 83 and 84 are mounted on the upper facing surface 74 of the base portion 71. In one possible form of the invention, the second end 86 of each of the reeding elements 83 and 84 cooperates with the upper facing surface of the base portion 71, and is resiliently moveable along a path of travel which is defined by the base portion. In the form of the invention as seen in the drawings, the base portion 71 has opposite first and second ends 72 and 73, and opposite first and second laterally oriented edges 81 and 82, respectively. In this arrangement, the first end 85 of the respective reeding elements 83 and 84 is mounted adjacent to the first lateral edge 81 and in spaced relation relative to the opposite first and second ends 72 and 73. In one form of the invention, a channel 80 is formed in the upper facing surface 74 and further extends from the first end 72 in the direction of the second end 73. The channel is defined by spaced sidewalls 80*a* and 80*b*, and is further located adjacent to the second lateral edge 82 of the base portion. In one possible form of the invention, the second end 86 of the respective reeding elements 83 and 84 is received within the channel 80, and the channel 80, defines a course of travel of the second end of the respective reeding elements. In the form of the invention as seen in the drawings, it will be seen that the first and second ends 85 and 86 of the respective reeding elements are firmly affixed to the top surface 74 of the base portion 71.

The respective wedge assemblies 60 which each have opposite first and second ends 85 and 86 are each defined by a first, second, and third course 91-96, respectively. Still further, the first reeding element 83 is located in spaced relation relative to the first end 72 of the wedge assembly 60, and the second reeding element 84 is located in spaced relation relative to the second end 73 of the wedge assembly 60. In the arrangement as seen in the drawings, the first and second courses 91 and 92 of the first reeding element are longer than the first and second courses 94 and 95 of the second reeding element. Still further, the third course 93 of first reeding element is shorter than the third course 96 of the second reeding element. In addition to the foregoing, it will be recognized that a first angle 97*a* and 97*b* is defined between the first and second courses of each of the first and second reeding elements 83 and 84, respectively, and wherein a second angle 98*a* and 98*b* is defined between the second and third courses of each of the first and second reeding elements 83 and 84. In the arrangement as seen in the drawings, the first angle 97*a* of the first reeding element 83 is less than the first angle 97*b* of the second reeding element 84. Further, the second angle 98*a* of the first reeding element 83 is greater than the second angle 98*b* of the second reeding element 84.

A second aspect of the present invention 10 relates to a method for removing a weft thread 41 from an edge 35 of a fabric 34. In its broadest aspect, the present method includes as a first step engaging a first end 114 of a weft thread 41 which is to be removed from a forward edge 35 of a fabric 34. In this arrangement, the weft thread 41 has an opposite second end 115. The method includes a second step of progressively separating the weft thread 41 which is to be removed from the forward edge 35 of the fabric 34 and wherein the progressive separation, which is effected by the selective operation of the respective wedge assemblies 60, extends in a direction from the first end 114 of the weft thread to the second end 115 thereof. Still further, the method includes, as a third step, removing the weft thread 41 which has been separated from the forward edge 35 of the fabric 34.

More specifically, a method 10 for removing weft threads 41 from a forward edge 35 of a fabric 34 includes as a first step, providing a fabric 34 having a forward edge 35, and opposite lateral edges 43, and wherein the fabric 34 comprises both warp and weft threads 40 and 41, respectively. The method as described above includes another step of engaging a first end 114 of a weft thread 41 to be removed from the forward edge 35 of the fabric 34, and wherein the first end is near one of the lateral edges 43 of the fabric 34. The method includes another step of moving the first end 114 of the weft thread 41 which has been engaged in the previous step away from the forward edge 35 of the fabric 34. The method includes yet another step of imparting a substantially longitudinally directed pulling force to the first end 114 of the weft thread 41 which has been engaged. The method also includes another step of progressively, forcibly separating the weft thread 41 which has been engaged along its entire length from the forward edge 35 of the fabric 34; and further, removing the separated weft thread 41 from the fabric.

With respect to the step of engaging the first end 114 of a weft thread 41 to be removed and moving the first end 114 of the weft thread 41 which has been engaged away from the forward edge 35 of the fabric, the method includes the further steps of providing a moveable engagement assembly 110 and positioning the engagement assembly between a plurality of warp threads 40 of the fabric 34. The method includes another step of moving the engagement assembly along a reciprocal path of travel 111 into engagement with the first end 114 of the weft thread 41 which is to be removed from the forward edge of the fabric 35. In this regard, the path of travel 111 is substantially parallel to a plurality of warp threads 40 of the fabric 34. Still further, the method includes another step of moving the engagement assembly 110 along a path of travel 111 from the forward edge of the fabric 34 so as to move the first end 114 of the weft thread 41 away from the forward edge 35 of the fabric 34.

With respect to the step of imparting a longitudinally directed pulling force to the first end of the weft thread 114 which is to be removed, the method further comprises the steps of providing a moveable clamping assembly 120, and moving the clamping assembly to a first position 126 where it engages the first end 114 of the weft thread 41 which is to be removed from the forward edge 35 of the fabric 34. Still further, the method includes another step of moving the clamping assembly to a second position 127 which is in spaced position relative to the first position 126. In the methodology as discussed above, the step of progressively, and forcibly separating the weft thread 41 which has been engaged further includes the steps of providing a plurality of selectively moveable wedge assemblies 60; and positioning the respective wedge assemblies 60 below the forward edge 35 of the fabric 34. The method includes yet another step of sequentially moving each of the respective wedge assemblies 60 along a non perpendicular, and reciprocal path of travel 100 and into forcible separating contact therebetween the weft thread 41 which is to be removed, and the forward edge 35 of the fabric 34. In the methodology as described above, the step of removing the separated weft thread 41 from the forward edge of the fabric 35 further includes the steps of providing a draw-off device 130 which has moveable first and second portions 131 and 132; and positioning the first and second portions 131 and 132 in spaced relation, one relative to the other. The method includes yet another step of orienting the first end 114 of the weft thread 41 which is to be removed between the spaced apart first and second portions 131 and 132; and moving the first and second portions 131 and 132 of the draw-off device 130 together so as to securely capture the first end 114 of the weft thread 41 to be removed within the draw-off device. The method includes yet another step of synchronously rotating the first and second portions 131 and 132 of the draw-off device 130 so as to roll up, and thus remove the separated weft thread 41 from the fabric 34.

The methodology of the present invention 10 further includes a step of providing a controller 150 which is operably controllably coupled with each of the plurality of wedge assemblies 60; engagement assembly 110; movable clamping assembly 120; and draw-off device 130. The controller 150 selectively energizes and coordinates the operation of these same components so that the weft thread 41 which is to be removed is serially, selectively displaced from the forward edge 35 of the fabric 34; experiences a longitudinal pulling force so as to position the first end 114 of the weft thread 41 to be removed within a draw-off device 130; and thereafter is progressively separated from the forward edge 35 of the fabric 34. This separation is achieved by simultaneously energizing the draw-off device in order to continue to exert a longitudinal pulling force along the weft thread 41 to be removed. The draw-off device 130 simultaneously removes the weft thread 41 as it becomes progressively separated in a direction extending from one lateral edge 43 to the opposite second lateral edge 44, thereof by the action of the sequentially activated wedge assemblies 60.

Therefore it will be seen that the method and apparatus for removing weft threads from the edge of the fabric 10 provides a convenient means whereby manufacturers of substantially continuous fabric belts may rapidly, conveniently and accurately prepare a fabric 34 in a fashion so that endless fabric belts may be fabricated in a fashion not possible heretofore.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A weft thread removal apparatus, comprising:

a bed for supporting a fabric which is manufactured from both warp and weft threads, and which further has a forward edge, and opposite lateral edges;

a selectively rotatable draw-off device mounted adjacent to one of the lateral edges of the fabric and which forcibly engages a first end of a weft thread which is to be removed; and a plurality of wedge assemblies which are mounted on the bed, and which are selectively moveable relative to the forward edge of the fabric, and which facilitate the separation of the weft thread which has been engaged from the forward edge of the fabric.

2. An apparatus as claimed in claim 1, and further comprising:

a reciprocally moveable engagement assembly which has a moveable weft thread engagement element which engages the first end of the weft thread which is to be removed from the forward edge of the fabric, and wherein the engagement assembly is received between the warp threads which extend from the forward edge of the fabric and further displaces the first end of the weft thread to be removed to location in spaced relation relative to the forward edge of the fabric.

3. An apparatus as claimed in claim 2, and further comprising:

a reciprocally moveable clamping device which is oriented adjacent to one of the lateral edges of the fabric and which cooperates with the draw-off device, and wherein the reciprocally moveable clamping device moves into contact with the first end of the weft thread which has been displaced by the engagement assembly, and further exerts a longitudinally directed pulling force to the first end of weft thread to be removed so as to position the first end of weft thread within the draw-off device.

4. An apparatus as claimed in claim 3, and wherein the plurality of wedge assemblies, when selectively moved, extend, at least in part, through the warp threads, and between the weft thread which is to be removed, and the forward edge of the fabric, and wherein each of the wedge assemblies has a base portion having an upper and lower facing surface, and a first and second end, and wherein a plurality of reeding elements are mounted in spaced relation on the upper facing surface of each of the base portions, and wherein the respective reeding elements each have a different height and width dimension.

5. An apparatus as claimed in claim 4, and further comprising:

a controller which is controllably coupled with each of the engagement assembly, draw-off device, clamping device, and the plurality of wedge assemblies, and wherein the controller selectively moves each of the respective wedge assemblies sequentially so as to progressively separate the weft thread to be removed from the forward edge of the fabric, and wherein the weft thread is progressively separated by the actions of the moveable wedge assemblies in a direction which extends from the first end to the second end thereof.

6. An apparatus as claimed in claim 5, and wherein the controller causes the clamping device to exert a continuous longitudinally directed pulling force on the first end of the weft thread to be removed while the plurality of wedge assemblies are progressively separating the weft thread to be removed from the forward edge of the fabric.

7. An apparatus as claimed in claim 6, and wherein the draw-off device further comprises:

a first portion;

a second portion;

means for moving the first and second portions, one relative to the other; and a selectively energizeable motor for synchronously rotating the first and second portions, and wherein the controller causes the first and second portions to move together so as to capture the first end of the weft thread to be removed therebetween the first and second portions of the draw-off device and further synchronously rotates the first and second portions so as to remove the weft thread which has been forcibly separated from the forward edge of the fabric.

8. An apparatus as claimed in claim 1, and wherein each of the wedge assemblies comprise:

a base portion having an upper and a lower facing surface; and a plurality of reeding elements each having a different height and width dimension and which are individually mounted in spaced relation on the upper facing surface of the base.

9. An apparatus as claimed in claim 8, and wherein each reeding element has a first end, and an opposite second end, and wherein the first and second end of each reeding element is mounted on the upper facing surface of the base portion.

10. An apparatus as claimed in claim 8, and wherein the second end of each reeding element cooperates with the upper facing surface of the base portion and is resiliently moveable along a path of travel which is defined by the base portion.

11. A weft thread removal apparatus, comprising:

a bed having an upper supporting surface which supports a fabric which is manufactured from both warp and weft threads, and wherein the fabric further has a forward edge, and opposite lateral edges, and wherein the bed defines an aperture extending therethrough;

an engagement assembly mounted on the bed and adjacent to one of the lateral edges of the fabric, and wherein the engagement assembly is reciprocally moveable along a path of travel which is substantially parallel to the warp threads, and wherein the engagement assembly when moving along the reciprocal path of travel engages a first end of a weft thread which is to be removed from the forward edge of the fabric, and displaces the first end to a location which is in spaced relation relative thereto;

a moveable clamping assembly cooperating with the bed, and which engages the displaced first end of the weft thread to be removed and exerts a longitudinally oriented pulling force on the first end;

a draw-off device which may be selectively energized, and which is positioned adjacent to the clamping assembly, and wherein the first end of the weft thread to be removed is secured within the draw-off device;

a plurality of moveable wedge assemblies which are mounted below the upper supporting surface of the bed, and which can be selectively actuated so as to move along a reciprocal path of travel, and extend, at least in part, through the aperture defined by the bed, and facilitate the separation of the weft thread to be removed from the forward edge of the fabric which is supported on the bed; and a controller operably coupled-to each of the plurality of the moveable wedges, and the draw-off device, and wherein the respective moveable wedges are first, individually sequentially moved so as to separate the weft thread from the forward edge of the fabric, and once separated, the controller energizes the draw-off device so as to remove the separated weft thread from the fabric.

12. An apparatus as claimed in claim 11, and wherein the engagement assembly is reciprocally moveable within the aperture which is defined by the bed, and further extends, at least in part, through a plurality of warp threads of the fabric which extend from the forward edge of fabric and span across the aperture as defined by the bed.

13. An apparatus as claimed in claim 11, and wherein the clamping assembly is reciprocally moveable along a path of travel which is substantially parallel to the weft threads of the fabric, and perpendicular to the reciprocal path of travel of the engagement assembly.

14. An apparatus as claimed in claim 11, and wherein the draw-off device further comprises:

a first portion;

a second portion;

means for moving the first and second portions, one relative to the other; and a selectively energizeable motor for synchronously rotating the first and second portions, and wherein the controller causes the first and second portions to move together so as to capture the first end of the weft thread to be removed therebetween the first and second portions of the draw-off device, and further synchronously rotates the first and second portions so as to remove the weft thread which has been forcibly separated from the forward edge of the fabric.

15. An apparatus as claimed in claim 14, and wherein the clamping assembly is reciprocally moveable along a path of travel which extends between the first and second portions of the draw-off device when the first and second portions are oriented in spaced relation, one relative to the other, and wherein the longitudinally directed pulling force exerted by the clamping assembly on the first end of the weft thread to be removed is effective for drawing the weft thread, at least in part, between and through the spaced first and second portions of the draw-off device prior to the first and second portions moving together so as to capture the first end of the weft thread to be removed therebetween the first and second portions of the draw-off device.

16. An apparatus as claimed in claim 1, and wherein the wedge assemblies each comprise:

a base portion having an upper and a lower facing surface; and a plurality of moveable reeding elements mounted in spaced relation on the upper facing surface of the base, and wherein the moveable reeding elements each have a different height and width dimension.

17. An apparatus as claimed in claim 16, and wherein each reeding element has a first end, and an opposite second end, and wherein the first and second end s of the respective reeding elements are mounted on the upper facing surface of the base portion.

18. An apparatus as claimed in claim 16, and wherein the second end of each reeding element cooperates with the upper facing surface of the base portion and is resiliently moveable along a path of travel which is defined by the base portion.

19. An apparatus as claimed in claim 18, and wherein the base portion has opposite first and second ends, and opposite first and second laterally oriented edges, and wherein the first end of each of the reeding elements is mounted adjacent to the first lateral edge and in spaced relation relative to the opposite first end second ends, and wherein a channel is formed in the upper facing surface of the base portion and further extends from the first end in the direction of the second end, and wherein the channel is defined by spaced sidewalls, and is further located adjacent to the second lateral edge of the base portion, and wherein the second end of the respective reeding elements is received within the channel, and the sidewalls, which define the channel, define the course of travel of the second end of the respective reeding elements.

20. An apparatus as claimed in claim 16, and wherein each of the wedge assemblies has opposite first and second ends and a first and a second reeding element, and wherein each of the reeding elements are defined by a first, second, and third course, and wherein the first reeding element is located in spaced relation relative to the first end of the wedge assembly, and the second reeding element is located in spaced relation relative to the second end of the wedge assembly, and wherein the first and second courses of the first reeding element are longer than the first and second courses of the second reeding element, and wherein the third course of first reeding element is shorter than the third course of the second reeding element.

21. An apparatus as claimed in claim 20, and wherein a first angle is defined between the first and second courses of each of the first and second reeding elements, and wherein a second angle is defined between the second and third courses of each of the first and second reeding elements, and wherein the first angle of the first reeding element is less than the first angle of the second reeding element, and wherein the second angle of the first reeding element is greater than the second angle of the second reeding element.

* * * * *